United States Patent [19]

Clay

[11] 4,221,626

[45] Sep. 9, 1980

[54] HEAT SEAL MACHINE

[75] Inventor: Bobby J. Clay, Cincinnati, Ohio

[73] Assignee: Natmar, Inc., Cincinnati, Ohio

[21] Appl. No.: 933,185

[22] Filed: Aug. 14, 1978

[51] Int. Cl.[2] ..... B30B 15/20; B30B 15/22; B30B 15/34

[52] U.S. Cl. ..... 156/366; 100/93 P; 100/219; 100/233; 100/259; 100/280; 100/283; 156/583.8; 156/583.9

[58] Field of Search ..... 156/358, 366, 583.1, 156/583.8, 583.9, 352; 100/93 P, 259, 260, 280, 293, DIG. 17, 219, 233, 283

[56] References Cited

U.S. PATENT DOCUMENTS

| | | | |
|---|---|---|---|
| 2,369,362 | 2/1945 | Marziani | 156/583.9 |
| 2,766,810 | 10/1956 | Gibson | 156/366 |
| 2,927,620 | 3/1960 | Elliott | 100/93 P |
| 3,035,951 | 5/1962 | Braun et al. | 156/583.9 |
| 3,149,560 | 9/1964 | Finke | 100/93 P |
| 3,316,582 | 5/1967 | Johnston et al. | 16/51 |
| 4,058,055 | 11/1977 | Douglas | 156/583.9 |

*Primary Examiner*—Michael G. Wityshyn
*Attorney, Agent, or Firm*—Wood, Herron & Evans

[57] ABSTRACT

An improved heat seal machine having a lever linkage that cooperates with an electromagnet clamp to hold down a movable platen in heat sealing relation against a base platen after manual closure of the two platens into sealing relation. A spring operated opener returns the movable platen into home position after the electromagnet clamp is released, the opener cooperating with a dampener device that controls the opening rate of the movable platen.

25 Claims, 7 Drawing Figures

10

HEAT SEAL MACHINE

This invention relates to machines having two platens, one being movable relative to the other. More particularly, this invention relates to a machine of the platen type adapted to heat seal one substrate to another.

Heat seal machines are known to the prior art, and are currently available in the market place. Basically, a heat seal machine includes an upper platen and a lower platen, at least one of the platens being heated. When the platens are in the closed or press position, a first substrate with a heat sealable adhesive may be affixed onto a second substrate. When the platens are in the opened or home position, new substrates or workpieces may be put in place. One particular use for this type machine is sealing labels into the collars of shirts or uniforms or other garments.

One heat seal machine known to the prior art includes a lower platen mounted on springs attached to a base frame. The upper platen is manually closable from an open position to a closed position. In the closed position, the upper platen presses against the lower platen, thereby partially compressing the lower platen's mounting springs. The upper platen is held in the closed position by a latch linkage arrangement. The latch linkage is released from the latched position by a solenoid after the heat seal cycle time has expired, as measured by a timer in a control circuit. When the latch linkage is unlatched, the lower platen's springs provide upward thrust to the upper platen for returning the upper platen to the opened position. The upper platen is retained in that opened position by a home latch. Although this prior art heat seal machine has seen success in the market place, the structure that results in its operational sequence is such that it may present an injury risk to an operator when the upper platen pops open from its closed position back to its home position. This for the reason that the spring force generated by the lower platen against the upper platen to move the upper platen back into its home position effects a substantially uncontrolled and rapid movement by the upper platen. If an operator's hand or other extremity is inadvertently in the way of the upper platen during its return motion, some degree of injury may occur.

Therefore, it has been one objective of this invention to provide an improved heat seal machine having a novel structural combination by which the rate at which a movable platen is returned from its closed position to its opened position is at a controlled and relatively slow rate, thereby minimizing any injury risk upon inadvertent operator contact with the movable platen as it is returned.

It has been another objective of this invention to provide an improved heat seal machine having a novel hold down structure which cooperates with a first platen to hold down that first platen in press or closed relation with a second platen.

In accord with these objectives, the heat seal machine of this invention comprises a lever linkage that cooperates with an electromagnet clamp to hold down a movable platen in heat sealing relation against a base platen after manual closure of the two platens into sealing relation. A spring operated opener returns the movable platen into home position after the electromagnet clamp is released, the opener cooperating with a dampener device that controls the opening rate of the movable platen.

Other objectives and advantages of the invention will be more apparent from the following detailed description taken in conjunction with the drawings in which.

Figure 1:
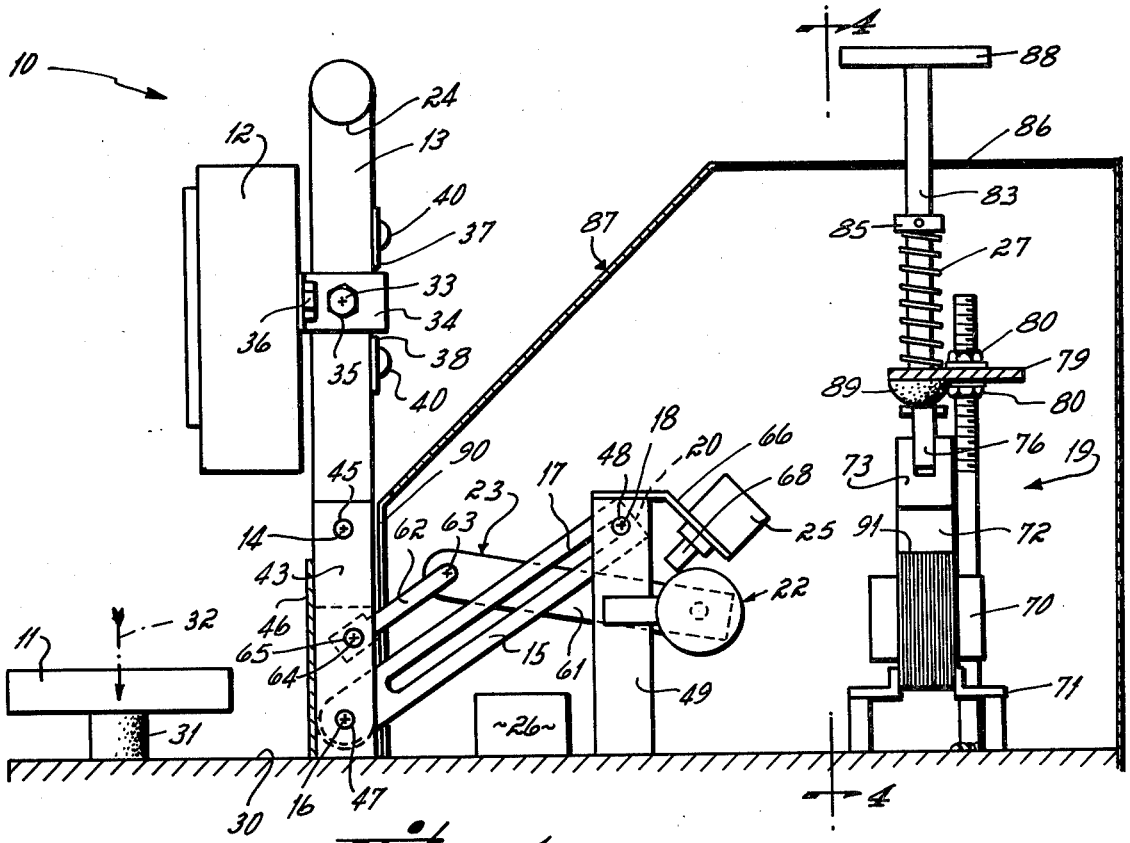
FIG. 1 is a side elevation view illustrating an improved heat seal machine in accord with the principles of this invention, a movable platen being illustrated in the opened or home position.
Figure 2:
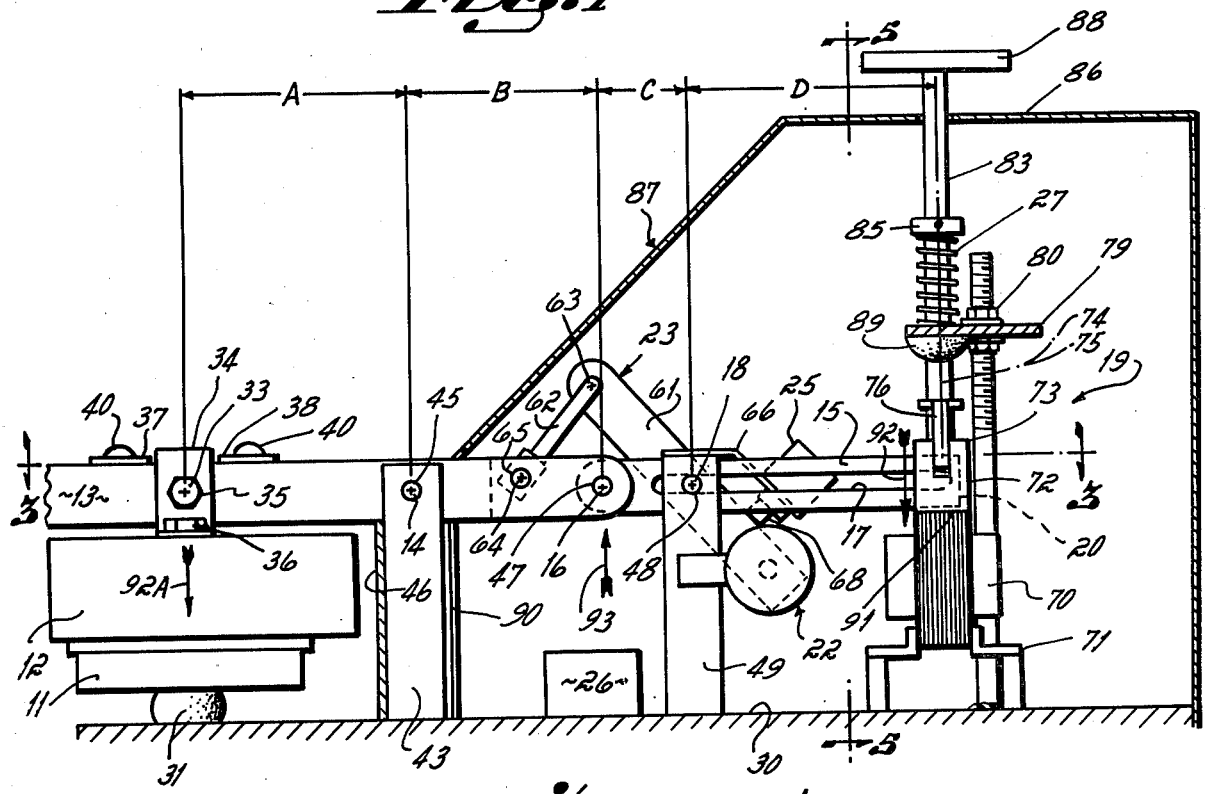
FIG. 2 is a side elevational view similar to FIG. 1, but illustrating the movable platen in the closed or press position.

The basic structural components and operation sequence of an improved heat seal machine 10 in accord with the principles of this invention is illustrated in FIGS. 1 and 2. As shown in those figures, the heat seal machine 10 comprises a stationary base or lower platen 11, and a movable upper platen 12, the upper platen being movable between an opened or home position shown in FIG. 1 and a closed or press position shown in FIG. 2. The upper platen 12 is mounted on platen arm 13 that pivots about axis 14. A lever arm 15 is pivotally connected to one end of the platen arm on axis 16, and is pivotally connected in motion slot 17 on fixed or immobile pivot axis 18. An electromagnet clamp 19 cooperates with the free end 20 of the lever arm 15 when the upper platen 12 is in the press position to hold that lever arm and, hence, the upper platen, in the press position. A spring 21 loaded opener 22 is also connected to the platen arm 13 through opener linkage 23, the opener linkage functioning to open the upper platen from the press position to the home position when the lever arm 15 is released by the electromagnet clamp 19. In use, the upper platen 12 is moved from the home or opened position shown in FIG. 1 to the closed or press position shown in FIG. 2 by manually drawing down the platen through use of handle 24. In the press position, the opener linkage 23 activates switch 25 which, through a control circuit not shown, energizes the electromagnet clamp 19. When the electromagnet clamp 19 is activated, the clamp cooperates with free end 20 of the lever arm 15 (see FIGS. 2 and 5) to hold the upper platen 12 in the press position shown in FIG. 2. Activation of the switch 25 also energizes timer 26 through a control circuit, not shown. When the timer 26 times out, the control circuit, not shown, deactivates the electromagnet clamp 19, thereby causing the clamp to return to the home position (see FIGS. 1 and 4) through use of return spring 27. The spring 21 loaded opener 22 thereafter opens the upper platen 12 from the press position shown in FIG. 2 to the home position shown in FIG. 1.

The heat seal machine 10, more specifically, includes a base platen 11 mounted to base frame 30 on rubber mount block 31. The lower platen 11 is, therefore, slightly movable in a downward direction, shown by the phantom arrow 32, in response to pressure in that direction from the upper platen 12, which pressure may result in slight compression of the rubber mount block.

The upper or movable platen 12 is pivotally mounted to the platen arm 13 on pivot axis 33 through use of bracket 34 and bolt 35, the bracket being fixed to the upper platen by bolts 36. The platen arm 13 is provided with a limit stop structure that defines the pivot motion limits of the upper platen 12 relative to that platen arm. The limit stop structure is in the nature of two stop plates 37, 38, one positioned on either side of the platen's mounting bracket 34. Each of the stop plates 37, 38 is provided with a slot 39 through which the plate is fixed to the platen arm 13 by screw 40, thereby permitting the limit stop plates to be adjusted on the platen arm, and thereby permitting the pivot motion arc of the upper platen 12 to be adjusted, as desired by the user. Oftentimes the substrates or workpieces (not shown) being heat sealed together, as placed in overlapped relation on the lower platen 11, present a somewhat uneven surface, and the pivot connection of the upper platen 12 with the platen arm 13 permits some accommodation to that unevenness of the workpieces. The upper platen 12 is provided with heater means, e.g., electrical resistance heaters, not shown, for heating the platen to a desired temperature as governed by a controller, not shown, all as incorporated in an electrical control circuit, not shown.

The platen arm 13 itself is pivotally connected between two upright posts 43, 44 fixed to the base frame 30 by pin 45. The pivot connection 14 of the platen arm 13 is between the two ends of that platen arm, one end of the platen arm carrying the manual handle 24. A stop plate 46 is fixed to the two posts 43, 44 across the front edge of those posts, the stop plate cooperating with platen arm 13 to define the opened position for the platen arm and, hence, for the upper platen 12, as shown in FIG. 1.

The lever arm 15 is pivotally connected to that end of the platen arm 13 opposite to the upper platen 12 by pin 47. The lever arm 15 defines an elongated slot 17 longitudinally disposed therethrough. The lever arm slot 17 cooperates with pin 48 fixed in position between two support posts 49, 50, these posts also being fixed to the base frame 30. Thus, the lever arm 15 is pivotally mounted to the base frame 30 at the other end thereof, and that pivot connection 17, 48 is adapted to slide longitudinally of the lever arm 15 because of slot 17, compare FIG. 1 to FIG. 2. Note in this connection that the distance A between the pivot axis 33 of platen 12 with platen arm 13 and the platen arm's pivot axis 14 is substantially equal to the distance B between the platen arm's pivot axis 14 and the pivot axis 16 of lever arm 15 with platen arm 13. Note also that, when the upper platen 12 is in the press position shown in FIG. 2, the distance C between the lever arm's axis 18 and the platen arm's pivot axis 16 is about one-fourth the distance D between the pivot axis 18 of lever arm 15 with posts 49, 50 and the free end 20 when in the hold down location of electromagnet clamp 19. The relative importance of these distances will be explained in more detail below.

Figure 6:
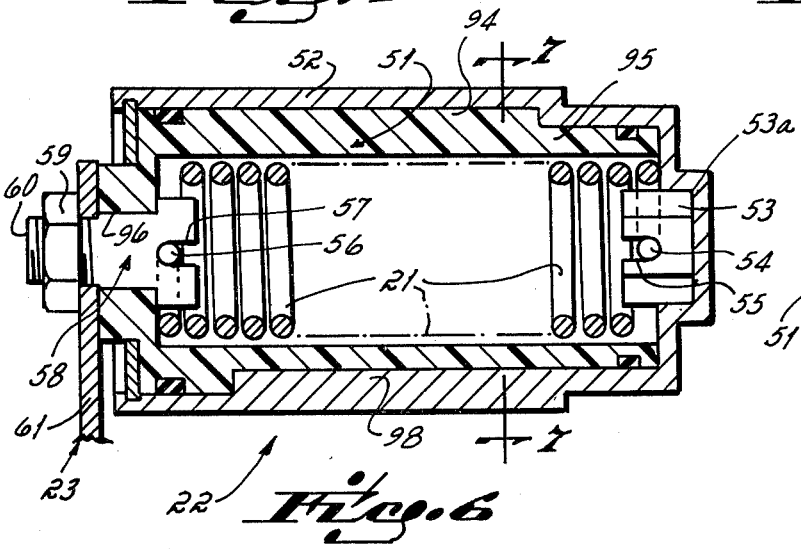
FIG. 6 is a longitudinal cross sectional view of the platen opener.
Figure 7:
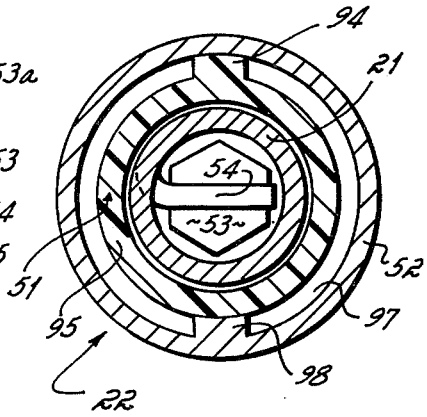
FIG. 7 is a cross sectional view taken on line 7—7 of FIG. 6.

The opener 22 is fixed in place to the base frame 30. The opener 22 includes, as shown in FIG. 6, a spring 21 motor and a hydraulic dampener device 51, all incorporated in a single housing 52. The coil spring 21 motor is connected at one end to base fitting 53 held in fixed relation in seat **53*a* in the housing, the fitting having the same cross sectional configuration, e.g., hexagonal, as the seat to secure it against rotation, and spring end 54 being received in the fitting's cross bore 55. The other end 56 of the spring 21 is received in cross bore 57 of a head fitting 58 that extends exteriorly of the housing, and is fixed to the opener linkage 23 by nut 59 and threaded shaft 60. The spring 21 motor is also connected with the hydraulic dampener device 51, that device including a cylindrical rotor 95 concentrically positioned relative to the coil spring within the housing 12. The cylindrical rotor 95 is connected with the coil spring 21 through use of rotor bore 96 cooperating with the spring's head fitting 58, the rotor bore 96 and the head fitting 58 both have the same polyganol cross sectional configuration, e.g., hexagonal, to prevent rotation of rotor 95 relative to head fitting 58. The rotor 95, as illustrated particularly in FIG. 7, is of an outside diameter substantially less than the inside diameter of the housing, for defining a chamber 97 therebetween. The rotor 95 includes a vane 94 extending outward, and the housing includes a vane 98 extending radially inward, the rotor vane and the housing vane cooperating to define the substantially 180° travel limit of the rotor. The chamber 97 is filled with a highly viscous hydraulic fluid. In use, and when the upper platen 12 is pulled downwardly into press relation with the lower platen 11 as shown in FIG. 2, the head fitting 58 is pivoted so as to increase the rotational spring 21 force. When the upper platen 12 is released, the rotational spring 21 force returns that upper platen to the storage or home position shown in FIG. 1, but at a controlled opening rate that is slow (relative to the return rate that would occur without the dampener device 51) because of the rotor vane 94 pushing through the viscous hydraulic fluid in the chamber 97. The rotor 95 is caused to rotate, of course, because it too is connected with the head fitting 58 connected to spring 21**.

Figure 3:
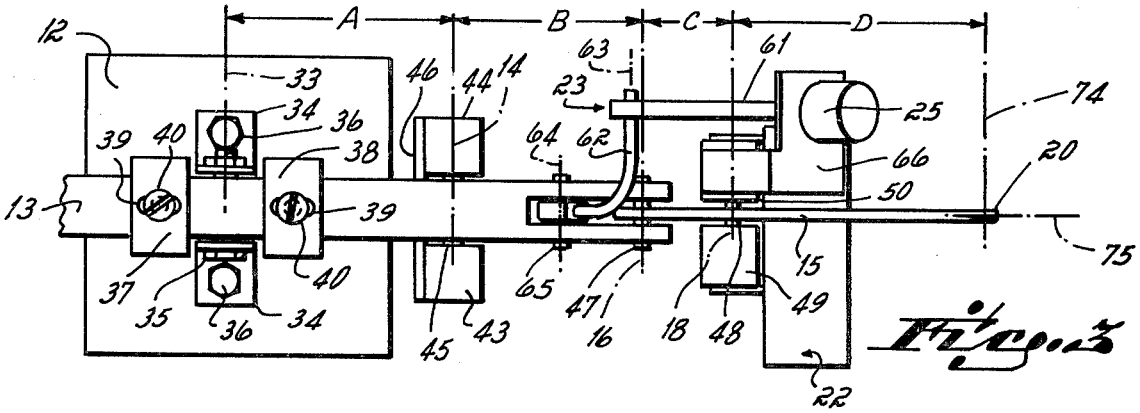
FIG. 3 is a cross sectional view taken along line 3—3 of FIG. 2.

The opener 22 is connected through primary 61 and secondary 62 arms to the same end of the platen arm 13 to which the lever arm 15 is connected, see FIGS. 2 and 3. The opener's primary arm 61 is fixed to and rotatable by the opener 22 at one end, and the secondary arm 62 is pivotally connected to free end of the primary arm at one end on pivot axis 63, and is pivotally connected on pivot axis 64 by pin 65 to the platen arm 13 at the other end. Note that the pivot axis 64 of the opener linkage 61, 62, where connected to the platen arm 13, is connected between the platen arm's pivot axis 14 and the lever arm's pivot axis 16. The support post 50 also includes a bracket 66 which mounts the switch 25 incorporated in the machine's control circuit, not shown. The switch 25 includes plunger 68 adapted to be contacted by the opener's primary arm 61 when the upper platen 12 is in the press position shown in FIG. 2, and released by the opener's primary are when the upper platen is in the opened position shown in FIG. 1. This control switch 25 cooperates with the timer 26 (fixed to the base frame 30) in the control circuit, not shown, for the machine.

Figure 4:
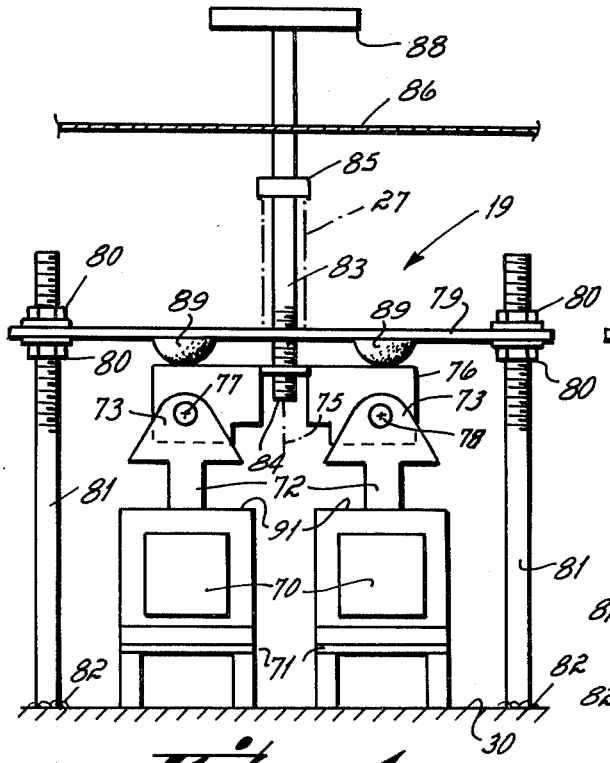
FIG. 4 is a cross sectional view taken along line 4—4 of FIG. 1.
Figure 5:
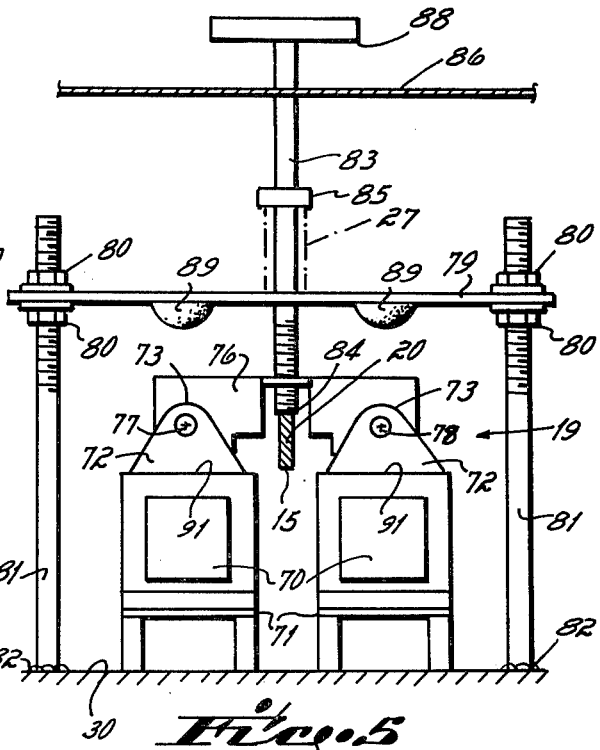
FIG. 5 is a cross sectional view taken along line 5—5 of FIG. 2.

The electromagnet clamp 19 is particularly illustrated in FIGS. 1 and 5. As shown in those figures, the electromagnet clamp 19 includes two coils 70 spaced apart one from another, the coils being fixed to respective brackets 71 that are mounted on the base frame 30. Each coil 70 is provided with an armature 72 having a T-shaped head 73, the armature being vertically reciprocable in a plane 74 generally perpendicular to the motion plane 75 of the lever arm 15. A hold down bar 76 is pivotally mounted, at points 77, 78, to the T-shaped heads 73 at opposed ends of that hold down bar. A mount plate 79 is located above the hold down bar 76, and is fixed in elevated spaced relation to the hold down bar by nuts 80 and threaded rod 81 fixed to the base frame 30 as at 82. A clamp adjustor or plunger 83 passes through the mount plate 79, and is threadedly engaged with the hold down bar 76 at its lower end, the tip 84 of the threaded plunger passing through the hold down bar in the motion plane 75 of the lever arm 15, see particularly FIG. 4. The plunger 83 is provided with a collar 85 intermediate its ends, the collar cooperating with the mount plate 79 for restraining return spring 27 therebetween. Note that the plunger 83 extends through ceiling 86 of the machine's housing 87, the plunger being provided with a handle 88 exteriorly of the housing. This allows the tip 84 of the plunger 83 to be positioned relative to the hold down bar 76 as required, and as explained in further detail below, from a location exterior of the machine's housing. The underside of the mount plate 79 is provided with bumpers 89 on either side of the plunger 83, the bumpers cooperating with the hold down bar 76 to locate the hold down bar when the clamp 19 is in the non-clamping or home position shown in FIG. 4. The T-shaped heads 73 of the clamp's armatures 72 seat against the coils 70 to locate the hold down bar 76 in the closed or press position, see FIG. 5.

The machine's housing 87 encloses the electromagnet clamp 19, the opener 22 structure, and the lever arm 15. Note the platen arm 13 is movable through slot 90 in the housing 87 between its open position shown in FIG. 1 and its closed position shown in FIG. 2.

In operation of the heat seal machine 10 of this invention, and preliminarily, the heater means, not shown, in the upper platen 12 is activated by an off/on switch, not shown. The upper platen 12, once proper heat has been reached, may be closed from the opened position shown in FIG. 1 to the closed position shown in FIG. 2. In the closed or press position shown in FIG. 2, the opener's primary arm 61 activates control switch 25 for the timer control circuit, not shown, thereby activating the timer itself. The control switch 25, through the timer 26 control circuit, not shown, also activates the electromagnet clamp 19 which causes the coils 70 to be energized, thereby drawing down the T-shaped heads 73 from the FIG. 4 position to the FIG. 5 position until same bottom out against the top surface 91 of the coils. Of course, the hold down arm 76 thereby simultaneously engages the end 20 of the lever arm 15 in a hold down relation as shown in FIGS. 2 and 5. In this hold down position and when, e.g., a lesser pressure of 20 p.s.i. is the hold down pressure provided by the hold down arm 76 against the free end 20 of the lever arm 15, a greater pressure of 80 p.s.i. is the compression pressure provided by the upper platen 12 against the lower platen 11. This for the reason that, as shown in FIG. 2, the distance D between the hold down location on the lever arm 15 and the lever arm's central pivot axis 18 is about four times as great as the distance C between the lever arm's central pivot axis 18 and the lever arm's pivot axis 16 connection with the platen arm 13. Further, and since the hold down force 92 is downwardly directed, same induces an upwardly directed force 93 at the lever arm 15 end of the platen arm 13. This, in turn, induces a downward force 92A on the upper platen 12 end of the platen arm 13, which downward force 92A is substantially equal to the upward force 93 at the lever arm 15 end because the distances A and B between pivot axes 33, 14 and 16, are substantially the same. Thus, downward force 92 generated by the electromagnet clamp's hold down bar 76 is translated into a substantially four times greater downward force 92A on the upper platen 12. In this use of the heat seal machine 10, it is important the clamp's T-shaped heads 73 bottom out against the top edges 91 of the coils 70 so that the electromagnet coils 70 do not hum or otherwise malfunction. Toward this end, and since the lever arm 15 is engaged by end 84 of the plunger 83, the position of this clamp adjustor or plunger 83 relative to the hold down bar 76 is adjustable by exterior handle 88. Hence, and if the thickness of the one or both of the workpieces to be joined on the lower platen 11 is significantly greater or lesser than the thickness of earlier joined workpieces, it may be desirable to adjust the plunger 83 position so as to accommodate the greater or lesser thickness as the case may be. When the timer 26 times out, the control circuit, not shown, deactivates the electromagnet clamp 19, thereby causing the hold down bar 76 to be returned from the hold down position shown in FIG. 5 to the home position shown in FIG. 4 through use of return spring 27.

The opener 22, through its primary 61 and secondary 62 arms, opens the upper platen 12 from its press position shown in FIG. 2 to its home position shown in FIG. 1 after the hold down bar 76 has been returned to the home position shown in FIG. 4 through deactivation of the electromagnet clamp 19. In this regard, the spring loaded opener 22 causes the opener's operator arm linkage 61, 62 to move counter-clockwise, compare FIG. 2 to FIG. 1, thereby causing the platen arm to pivot clockwise on axis 14. However, and because of the dampener 51 connected with the opener 22, the rate at which the upper platen 12 is spring 21 returned from the closed position to the open position is controlled, i.e., the upper platen does not just simply pop open at an uncontrolled rate. And because the controlled rate may be relatively slow due to the use of the dampener 51, any injury risk due to inadvertent operator contact with the upper platen 12 as it is returned toward the opened position from the closed position is thereby minimized.

Having described in detail the preferred embodiment of my invention, what I desire to claim and protect by Letters Patent is:

1. A heat seal machine operable to heat seal two workpieces together, said machine comprising first and second platens mounted on a frame, at least one of said platens including heater means for heating said platen to a desired temperature, a platen arm connecting said first platen to said frame, said platen arm permitting said first platen to be moved between opened and closed positions relative to said second platen, a lever linkage connected between said platen arm and said frame for pressing said first platen against said second platen when said first platen is in said closed position, said lever linkage being structured so that a lesser hold down pressure thereon will result in a greater compression pressure of said first platen against said second platen when said first platen in a said closed position, an electromagnet clamp mounted on said frame, said electromagnet clamp including at least one armature and at least one coil, one of said armature and coil being movable between a holddown position at which said holddown pressure is exerted on said lever linkage, and a release position to permit return of said first platen from said closed position to said opened position, and a clamp adjustor connected with said electromagnet clamp, said adjustor being operable to adjust the holddown position of said clamp in order to compensate for different thickness workpieces that may be positioned between said platens, said clamp adjustor thereby permitting said electromagnet clamp to hold said lever linkage in said press position without substantially altering the holddown position of said armature and said coil when a change is made in the thickness of workpieces positioned between said platens.

2. A heat seal machine as set forth in claim 1, said lever linkage comprising a lever arm pivotally connected to said platen arm at one end and pivotally connected to said frame between said one end and the other end thereof, said lever arm and said frame having cooperable motion slot and pivot pin structure that permits said lever arm's pivot connection with said frame to slide longitudinally of said lever arm as said platen moves between open and closed positions.

3. A heat seal machine as set forth in claim 2, said platen arm being pivotally mounted intermediate the ends thereof to said frame, said first platen being mounted on one end of said platen arm, said lever arm being connected with the other end of said platen arm, said lever arm's pivot connection with said frame being positioned closer to said lever arm's pivot connection with said platen arm when said platen is closed than is the case when said platen is opened, and said hold down pressure being exerted by said clamp against the other end of said lever arm.

4. A heat seal machine as set forth in claim 1, said electromagnet clamp comprising a coil and an armature reciprocable therein, and a spring normally biasing said armature to a release position, said coil drawing said armature into said holddown position when said coil is electrically activated.

5. A heat seal machine as set forth in claim 4, said electromagnet clamp comprising two armatures spaced one from another, each armature being reciprocable within a coil, and a holddown bar connected between said armatures, said holddown bar cooperating with said lever linkage to establish holddown pressure on said lever linkage, the motion plane of said holddown bar being generally normal to the motion plane of said lever linkage.

6. A heat seal machine as set forth in claim 5, said clamp adjustor comprising a stop mounted on said holddown bar, said stop cooperating with said lever linkage for locating said first platen in said closed position, said stop being movably positionable relative to said holddown bar, and a handle connected with said stop for permitting manual adjustment of said stop relative to said holddown bar as desired by an operator.

7. A heat seal machine as set forth in claim 4, said machine further comprising a timer connected with said electromagnet clamp, said timer being activated when said first platen is moved to said closed position, and said electromagnet clamp releasing said lever linkage after passage of a preset time period as determined by said timer, thereby permitting said first platen to return to said opened position.

8. A heat seal machine as set forth in claim 1, said machine comprising an opener connected with said platen for returning said first platen from said closed position to said opened position, and a dampener device connected with said opener, said dampener device controlling the rate at which said first platen is returned from said closed position to said opened position by said opener, said dampener device thereby minimizing any injury risk upon inadvertent operator contact with said first platen as said first platen is returned toward said opened position.

9. A heat seal machine as set forth in claim 8, said opener comprising a spring motor, said spring motor being restrained against operation by said electromagnet clamp when said electromagnet clamp is activated to hold said lever linkage in that position at which said first platen is pressed against said second platen, and said dampener device comprising a vane connected with said spring, said vane being positioned in a viscuous fluid containing chamber, and said vane being moved by said spring through said viscuous fluid as said first platen is returned from said closed position to said opened position.

10. A heat seal machine as set forth in claim 9, said first platen being pivotally mounted to said platen arm, and said second platen being pivotally mounted to said frame, said first platen pivot mounting comprising limit stop structure mounted on said platen arm, said limit stop structure defining the pivot motion limits of said first platen relative to said platen arm, and said second platen pivot mounting comprising a flexible mount connecting said second platen and said frame, said flexible mount being compressible in response to said first platen being pressed against said second platen.

11. A heat seal machine comprising first and second platens mounted on a frme, at least one of said platens including heater means for heating said platen to a desired temperature, and said first platen being movable between opened and closed positions relative to said second platen, a lever linkage connected between said first platen and said frame, said lever linkage functioning to press said first platen against said second platen when said first platen is in said closed position, said lever linkage comprising a lever arm pivotally connected to said first platen at one end and pivotally connected to said frame between said one end and the other end thereof, and said lever arm and said frame having cooperable motion slot and pivot pin structure that permits said lever arm's pivot connection with said frame to slide longitudinally of said lever arm as said platen moves between open and closed positions, and a clamp connected to said frame, said clamp exerting a pressure against said lever arm that tends to pivot said lever arm about said lever arm's pivot connection with said frame for pressing said first platen against said second platen when said first platen is closed, and said lever linkage being structured so that the compression pressure of said first platen against said second platen is greater than the holddown pressure exerted by said clamp on said lever arm.

12. A heat seal machine as set forth in claim 11, said platen arm being pivotally mounted intermediate the ends thereof to said frame, said first platen being mounted on one end of said platen arm, said lever arm being connected with the other end of said platen arm, said lever arm's pivot connection with said frame being positioned closer to said lever arm's pivot connection with said platen arm when said platen is closed than is the case when said platen is opened, and said holddown pressure being exerted by said clamp against the other end of said lever arm.

13. A heat seal machine as set forth in claim 11, said machine comprising an electromagnet clamp mounted on said frame, said electromagnet clamp including at least one armature and at least one coil, said armature and coil being movable between a holddown position at which said holddown pressure is exerted on said lever linkage, and a release position to permit return of said first platen from said closed position to said opened position.

14. A heat seal machine as set forth in claim 13, said electromagnet clamp comprising a coil and an armature reciprocable therein, and a spring normally biasing said armature to a release position, said coil drawing said armature into a holddown position when said coil is electrically activated.

15. A heat seal machine as set forth in claim 13, said machine further comprising a clamp adjustor connected with said electromagnet clamp, said adjustor being operable to adjust the holddown position of said clamp in order to compensate for different thickness workpieces that may be positioned between said platens, said clamp adjustor thereby permitting said electromagnet clamp to hold said lever linkage link in said press position without substantially altering the holddown position of said armature and said coil when a change is made in the thickness of workpieces positioned between said platens.

16. A heat seal machine as set forth in claim 15, said electromagnet comprising two armatures spaced one from another, each armature being reciprocable within a coil, and a holddown bar connected between said armatures, said holddown bar cooperating with said lever linkage to establish holddown pressure on said lever arm, the motion plane of said holddown bar being generally normal to the motion plane of said lever arm.

17. A heat seal machine as set forth in claim 16, said clamp adjustor comprising a stop mounted on said holddown bar, said stop cooperating with said lever linkage for locating said first platen in said closed position, said stop being movably positionable relative to said holddown bar, and a handle connected with said stop for permitting manual adjustment of said stop relative to said holddown bar as desired by an operator.

18. A heat seal machine as set forth in claim 13, said machine further comprising a timer connected with said electromagnet clamp, said timer being activated when said first platen is moved to said closed position, and said electromagnet clamp releasing said lever linkage after passage of a prset time period as determined by said timer, thereby permitting said firs platen to return to said opened position.

19. A heat seal machine as set forth in claim 11, said machine comprising an opener connected with said second platen for returning said first platen from said closed position to said opened position, and a dampener device connected with said opener, said dampener device controlling the rate at which said first platen is returned from said closed position to said opened position by said opener, said dampener device thereby minimizing any injury risk upon inadvertent operator contact with said first platen as said first platen is returned toward said opened position.

20. A heat seal machine as set forth in claim 19, said opener comprising a spring motor, said spring motor being restrained against operation by said electromagnet clamp when said electromagnet clamp is activated to hold said lever linkage in that position at which said first platen is pressed against said second platen, and said dampener device comprising a vane connected with said spring, said vane being positioned in a viscuous fluid containing chamber, and said vane being moved by said spring through said viscuous fluid as said first platen is returned from said closed position to said opened position.

21. A heat seal machine as set forth in claim 11, said first platen being pivotally mounted to said platen arm, and said second platen being pivotally mounted to said frame, said first platen pivot mounting comprising limit stop structure mounted on said platen arm, said limit stop structure defining the pivot motion limits of said first platen relative to said platen arm, and said second platen pivot mounting comprising a flexible mount connecting said second platen said said frame, said flexible mount being compressible in response to said first platen being pressed against said second platen.

22. A heat seal machine operable to heat seal two workpieces together, said machine comprising first and second platens mounted on a frame, at least one of said platens including means for heating said platen to a desired temperature, a platen arm connecting said first platen to said frame, said platen arm permitting said first platen to be moved between opened and closed positions relative to said second platen, a lever linkage connected between said platen arm and said frame for pressing said first platen against said second platen when said first platen is in said closed position, said lever linkage being structured so that a lesser hold down pressure thereon will result in a greater compression pressure of said first platen against said second platen when said first platen is in said closed position, and a clamp mounted on said frame, said clamp being movable between a hold down position at which said lesser hold down pressure is exerted on said lever linkage, and a release position to permit return of said first platen from said closed position to said opened position.

23. A heat seal machine as set forth in claim 22, said machine comprising a clamp adjustor connected with said clamp, said adjustor being operable to adjust the holddown position of said clamp in order to compensate for different thickness workpieces that may be positioned between said platens, said clamp adjustor thereby permitting said clamp to hold said lever linkage in aid press position without substantially altering the holddown position of said clamp when a change is made in the thickness of workpieces positioned between said platens.

24. A heat seal machine as set forth in claim 23, said lever linkage comprising a lever arm pivotally connected to said platen arm at one end and pivotally connected to said frame between said one end and the other end thereof, said lever arm and said frame having cooperable motion slot and pivot pin structure that permits said lever arm's pivot connection with said frame to slide longitudinally of said lever arm as said platen moves between open and closed positions, and said platen arm being pivotally mounted intermediate the ends thereof to said frame, said first platen being mounted on one end of said platen arm, said lever arm being connected with the other end of said platen arm, said lever arm's pivot connection with said frame being positioned closer to said lever arm's pivot correction with said platen arm when said platen is closed than is the case when said platen is opened, and said holddown pressure being exerted by said clamp against the other end of aid lever arm.

25. A heat seal machine as set forth in claim 23, said clamp being an electromagnet clamp comprising two armatures spaced one from another, each armature being reciprocable within a coil, a holddown bar connected between said armatures, said holddown bar cooperating with said lever linkage to establish holddown pressure on said lever linkage, the motion plane of said holddown bar being generally normal to the motion plane of said lever linkage, and a spring normally biasing said armature to a release position, said coil drawing said armature into said holddown position when said coil is electrically activated.

* * * * *

UNITED STATES PATENT AND TRADEMARK OFFICE

CERTIFICATE OF CORRECTION

PATENT NO. : 4,221,626

DATED : September 9, 1980

INVENTOR(S) : Bobby J. Clay

It is certified that error appears in the above-identified patent and that said Letters Patent are hereby corrected as shown below:

Column 4, line 52, change "are" to --arm--.

Column 8, line 39, change "frme" to --frame--.

Column 9, line 35, delete the word "link".

Column 9, line 66, change "prset" to --preset--.

Column 9, line 67, change "firs" to --first--.

Column 10, line 36, change the second occurrence of "said" to --and--.

Column 11, line 3, change "aid" to --said--.

Column 12, line 2, change "correction" to --connection--.

Column 12, line 6, change "aid" to --said--.

Signed and Sealed this

*Sixth* Day of *January 1981*

[SEAL]

*Attest:*

SIDNEY A. DIAMOND

*Attesting Officer*

*Commissioner of Patents and Trademark*